US005828004A

United States Patent [19]

Nazco et al.

[11] Patent Number: 5,828,004

[45] Date of Patent: Oct. 27, 1998

[54] WIRE NUT WITH JUMPER WIRE DEVICE

[76] Inventors: Martin Nazco, 418 9 St., Union City, N.J. 07007; Lionel Nazco, Sr., P.O. Box 357, North Bergen, N.J. 07047

[21] Appl. No.: 736,122

[22] Filed: Oct. 24, 1996

[51] Int. Cl.[6] ..... H01R 4/26

[52] U.S. Cl. ..... 174/87

[58] Field of Search ..... 174/87; 403/214, 403/396; 206/219, 221, 222; 439/840

[56] References Cited

U.S. PATENT DOCUMENTS 5,531,618 7/1996 Market ..... 174/87

5,632,645 5/1997 Love ..... 174/87

*Primary Examiner*—Bot L. Ledynh

*Assistant Examiner*—Joseph Waks

[57] ABSTRACT

A new Wire Nut with Jumper Wire Device for offering a wire nut with a jumper wire that allows connection to an electrical receptacle. The inventive device includes a wire nut, a jumper wire, and a threaded insert. In use, the Wire Nut with Jumper Wire Device 10 is fastened to a wire terminal 4 of an electrical receptacle 2 and more than one electrical power wire are fastened together using the wire nut 20 of the device.

3 Claims, 3 Drawing Sheets

FIG 3
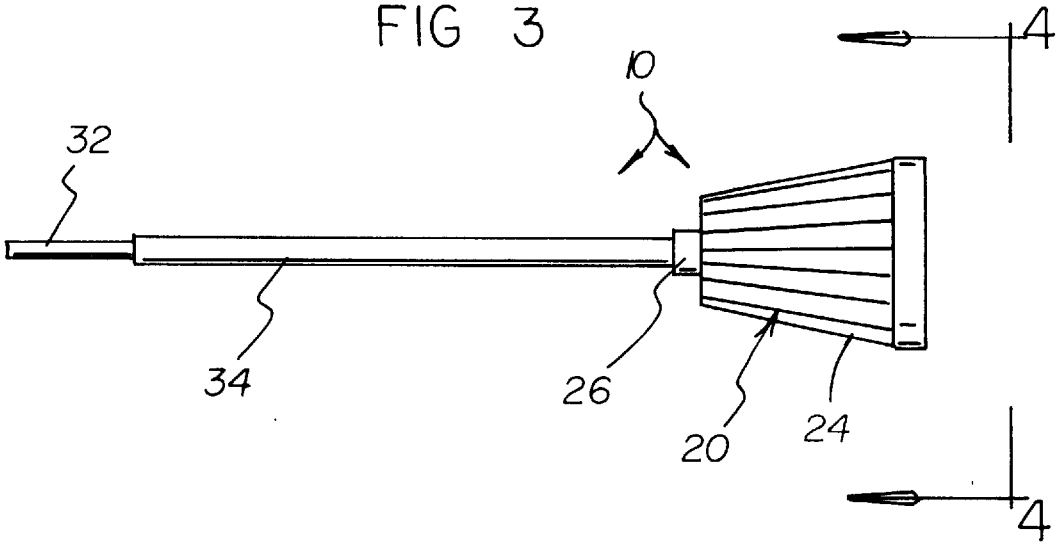
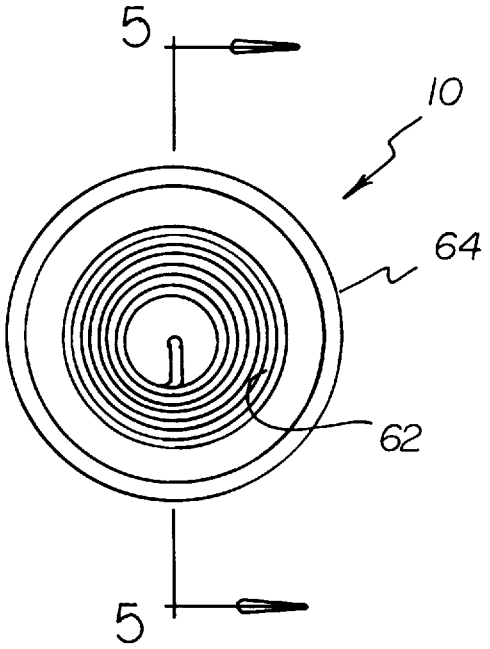
FIG 4

FIG 5
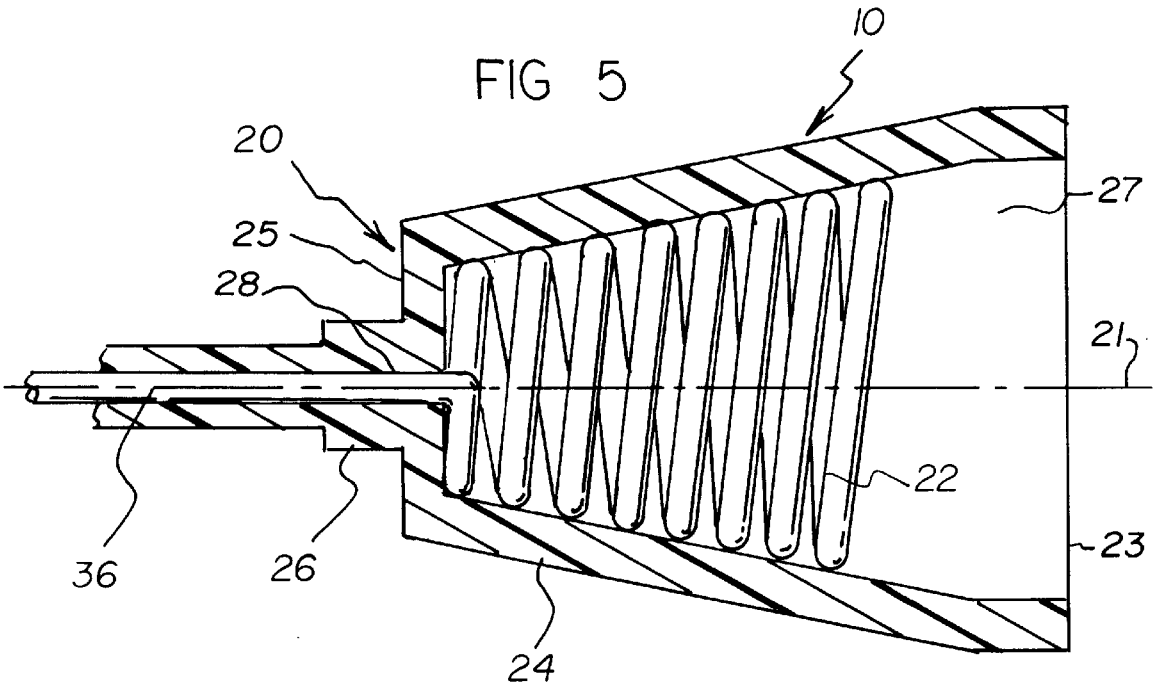
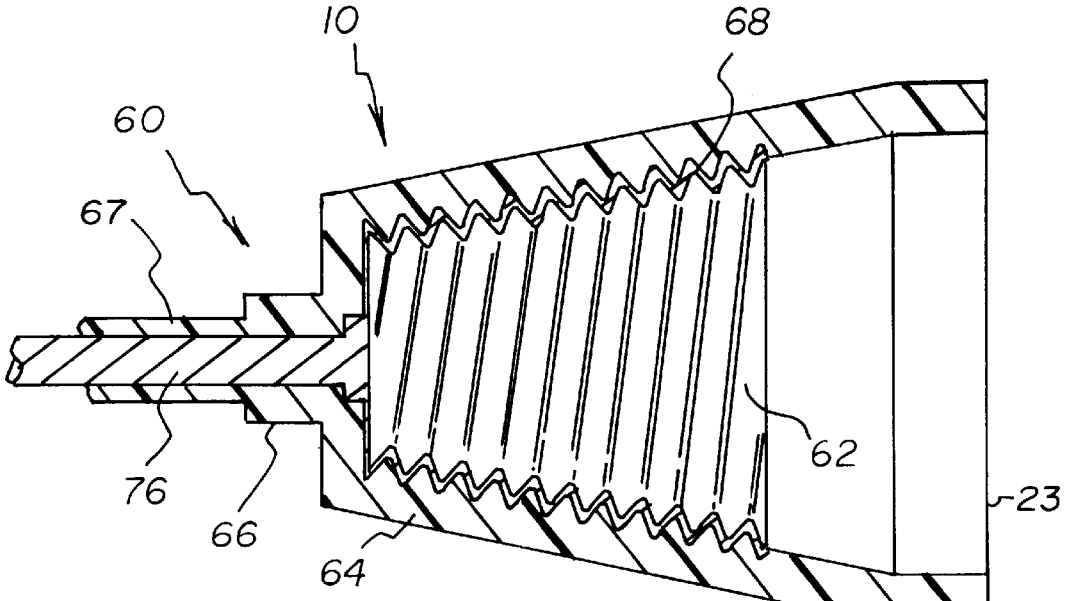
FIG 6

WIRE NUT WITH JUMPER WIRE DEVICE

BACKGROUND OF THE INVENTION

1. Field of the Invention

The present invention relates to wire nuts and more particularly pertains to a new Wire Nut with Jumper Wire Device for offering a wire nut with a jumper wire that allows connection to an electrical receptacle.

2. Description of the Prior Art

The use of wire nuts is known in the prior art. More specifically, wire nuts heretofore devise and utilized are known to consist basically of familiar, expected and obvious structural configurations, notwithstanding the myriad of designs encompassed by the crowded prior art which have been developed for the fulfillment of countless objectives and requirements.

Currently in the electrical trades, when wiring a home, many electrical wiring codes require the use of wire nuts when ever more than one wire needs to terminate on a terminal of an electrical receptacle. In order for the electrician to follow this code, he often cuts off a short length of wire known as a jumper wire, removes the insulation at each end of the jumper wire, and electrically fastens one end of the jumper wire to the terminal of the electrical receptacle, and he fastens the other end of the jumper wire to more than one other power wire using the old and well known wire nut.

Known prior art wire nuts include U.S. Pat. No. 5,132,494; U.S. Pat. No. 4,220,811; U.S. Pat. No. 5,179,253; U.S. Pat. No. 4,150,251; U.S. Pat. No. 5,112,252; and U.S. Pat. No. 4,104,482.

While these devices fulfill their respective, particular objectives and requirements, the aforementioned patents do not disclose a new Wire Nut with Jumper Wire Device. The inventive device includes a wire nut, a jumper wire, and a threaded insert.

In these respects, the Wire Nut with Jumper Wire Device according to the present invention substantially departs from the conventional concepts and designs of the prior art, and in so doing provides an apparatus primarily developed for the purpose of offering a wire nut with a jumper wire that allows connection to an electrical receptacle.

SUMMARY OF THE INVENTION

In view of the foregoing disadvantages inherent in the known types of wire nuts now present in the prior art, the present invention provides a new Wire Nut with Jumper Wire Device construction wherein the same can be utilized for offering a wire nut with a jumper wire that allows connection to an electrical receptacle.

The general purpose of the present invention, which will be described subsequently in greater detail, is to provide a new Wire Nut with Jumper Wire Device apparatus and method which has many of the advantages of the wire nuts mentioned heretofore and many novel features that result in a new Wire Nut with Jumper Wire Device which is not anticipated, rendered obvious, suggested, or even implied by any of the prior art wire nuts, either alone or in any combination thereof.

To attain this, the present invention generally comprises a wire nut, a jumper wire, and a threaded insert.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As Such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Wire Nut with Jumper Wire Device apparatus and method which has many of the advantages of the wire nuts mentioned heretofore and many novel features that result in a new Wire Nut with Jumper Wire Device which is not anticipated, rendered obvious, suggested, or even implied by any of the prior art wire nuts, either alone or in any combination thereof.

It is another object of the present invention to provide a new Wire Nut with Jumper Wire Device which may be easily and efficiently manufactured and marketed.

It is a further object of the present invention to provide a new Wire Nut with Jumper Wire Device which is of a durable and reliable construction.

An even further object of the present invention is to provide a new Wire Nut with Jumper Wire Device which is susceptible of a low cost of manufacture with regard to both materials and labor, and which accordingly is then susceptible of low prices of sale to the consuming public, thereby making such Wire Nut with Jumper Wire Device economically available to the buying public.

Still yet another object of the present invention is to provide a new Wire Nut with Jumper Wire Device which provides in the apparatuses and methods of the prior art some of the advantages thereof, while simultaneously overcoming some of the disadvantages normally associated therewith.

Still another object of the present invention is to provide a new Wire Nut with Jumper Wire Device for offering a wire nut with a jumper wire that allows connection to an electrical receptacle.

Yet another object of the present invention is to provide a new Wire Nut with Jumper Wire Device which includes a wire nut, a jumper wire, and a threaded insert.

Still yet another object of the present invention is to provide a new Wire Nut with Jumper Wire Device that prevents the make up of special jumper wires.

Even still another object of the present invention is to provide a new Wire Nut with Jumper Wire Device that minimizes the number of wires received by a wire nut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view of the present invention.

FIG. 4 is an end view of the present invention.

FIG. 5 a cross sectional view taken along line 5—5 of FIG. 4.

FIG. 6 is a cross sectional view of an alternate embodiment of the present invention.

DESCRIPTION OF THE PERFERRED EMBODIMENT

Figure 1:
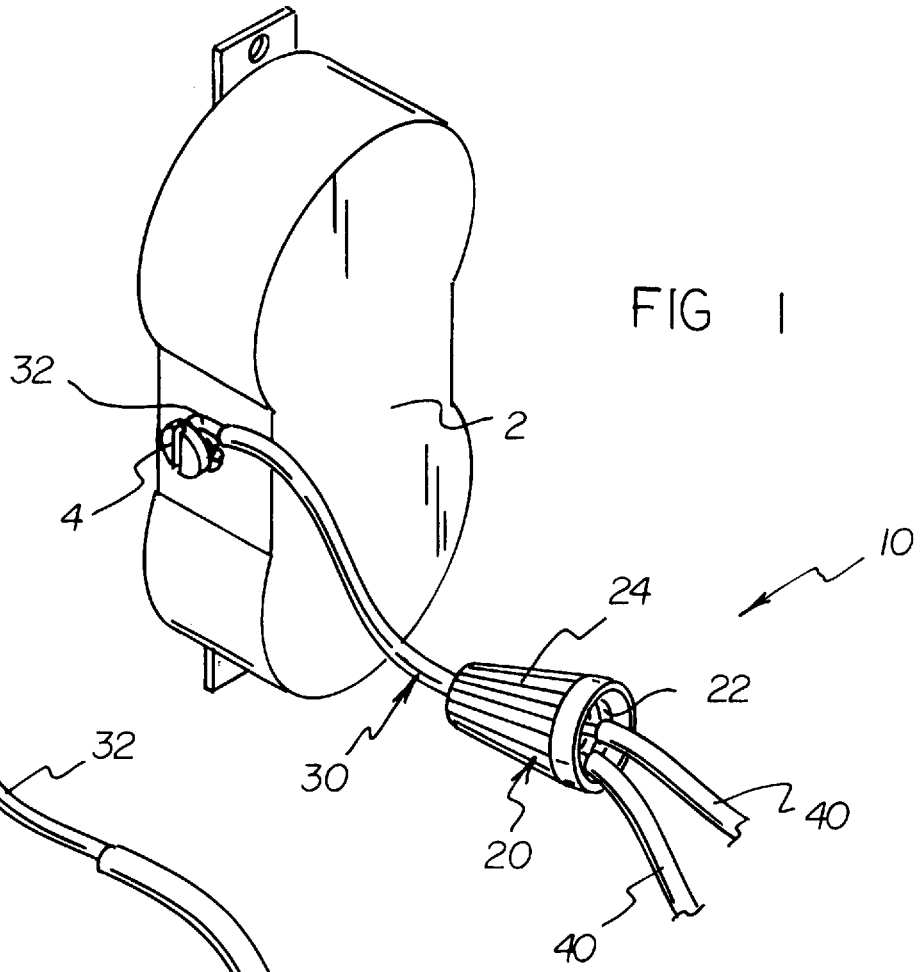
FIG. 1 is a right side perspective view of a new Wire Nut with Jumper Wire Device in use according to the present invention.
Figure 2:
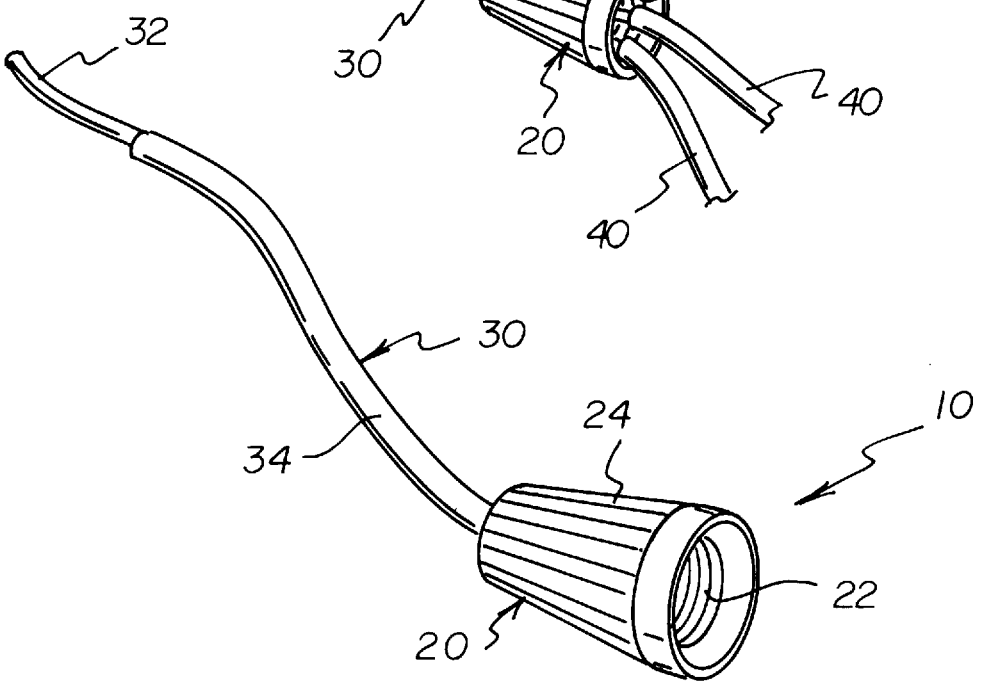
FIG. 2 is an enlarged right side perspective view of the present invention.

With reference now to the drawings, and in particular to FIGS. 1 through 6 thereof, a new Wire Nut with Jumper Wire Device embodying the principles and concepts of the present invention and generally designated by the reference numeral 10 will be described.

More specifically, it will be noted that the Wire Nut with Jumper Wire Device 10 comprises a wire nut 20 which in turn is comprised of a jumper wire 30, and a threaded insert 22 where the threaded insert 22 is in electrical connection with the jumper wire 30 and both the threaded insert 22 and the jumper wire 30 are fixedly attached to the wire nut 20.

As best illustrated in FIGS. 1 through 5, it can be shown that the wire nut 20 has a longitudinal axis 21 and is further comprised of a wire nut cover 24 and an insert shank 26 where the shape of the wire nut cover 24 is generally cylindrical and generally old and well known and deviates from old and well known prior art by virtue of the insert shank 26 which is an elongated cylindrical extension protrusion of the wire nut cover 24 and extends in a direction that is opposite of an old and well known wire entry end 23 of the wire nut 20 and where the insert shank 26 further includes an elongated cylindrical aperture which is sized to matingly and electrically insulatingly receive the jumper wire 30.

The insert shank 26 also lies in line and concentric with the wire nut cover 24 and the wire nut cover 24 and the insert shank 26 are made of one continuous material which is suitable for electrical insulation.

Additionally, the wire nut cover 24, the insert shank 26, and a wire insulation 34 for the jumper wire 30, are all made of one continuous material which is suitable for electrical insulation.

The jumper wire 30 is comprised of a terminal end 32 and a formed wire 36 where one end of the formed wire 36 forms the threaded insert 22 and therefore the formed wire 36 and the threaded insert 22 are made from one continuous wire and the terminal end 32 is further defined as the other end of the formed wire 36 and the wire insulation 34 provides electrical insulation for the formed wire 36.

Referring to FIG. 6, an alternate embodiment 60 is comprised of a tapered cylindrical threaded insert 62 which is threadedly received by a receiving thread 68 which is formed into an inner periphery of a tapered cylindrical cover 64.

The tapered cylindrical cover 64 further includes a tapered cylindrical shank 66 which is an elongated cylindrical extension 67 of the tapered cylindrical cover 64 and extends in a direction that is opposite of an entry end of the alternate embodiment 60 and where the tapered cylindrical shank 66 further includes an elongated cylindrical aperture which is sized to matingly and electrically insulatingly receive the jumper wire 30.

In the alternate embodiment 60, the jumper wire 30 is comprised of a swaged wire 76 that is electrically integral with the tapered cylindrical threaded insert 62.

It can be seen from the figures that the wire nut jumper device 10 of the invention comprises a substantially hollow wire nut cover 24 having a generally conically-shaped interior 27. The cover 24 has a closed end 25 and an open or wire entry end 23. The interior 27 of the wire nut cover 24 tapers from the open end 23 to the closed end 25. The closed end 25 has a passage 28 therethrough.

The wire nut jumper device 10 also comprises a jumper wire 30. The jumper wire 30 has an interior portion 22 located within the interior 27 of the wire nut cover 24. The interior portion 22 is formed into a threaded insert to function as a connection means for connecting the jumper wire 30 to one or more wires lodged in the interior of the wire nut cover 24. The jumper wire 30 also has an exterior portion 32 extending through the passage 28.

Preferably, the interior portion 22 of the jumper wire 30 is formed into a helical shape which is positioned adjacent to an interior wall of the wire nut cover 24.

In use, the Wire Nut with Jumper Wire Device 10 is fastened to a wire terminal 4 of an electrical receptacle 2 and more than one electrical power wire are fastened together using the wire nut 20 of the device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed and desired to be protected by Letters Patent of the United States is as follows:

1. A wire nut with jumper wire device comprising:

a wire nut;

a jumper wire;

a threaded insert where the threaded insert is in an electrical connection with the jumper wire and both the threaded insert and the jumper wire are fixedly attached to the wire nut;

said wire nut comprising a wire nut cover having a generally conical shape, wherein the wire nut cover, and a wire insulation for the jumper wire, are all made of one continuous material which is suitable for electrical insulation;

wherein the jumper wire is comprised of a terminal end and a formed wire, wherein one end of the formed wire forms the threaded insert and the formed wire and the threaded insert are made from one continuous wire wherein the terminal end is located opposite of the threaded insert of the formed wire, wherein the wire insulation provides electrical insulation for the formed wire.

2. The wire nut with jumper wire device of claim 1, wherein the wire nut cover further includes a cylindrical shank which is an elongated cylindrical extension protrusion of the wire nut cover and extends in a direction opposite of an entry end of the wire nut and where the cylindrical shank further includes an elongated cylindrical aperture which is sized to receive the jumper wire such that the jumper wire is electrically insulated within the tapered cylindrical shank.

3. A wire nut jumper device comprising:

a substantially hollow wire nut cover having a generally conical interior shape said cover having closed and open ends said interior tapering from said open end to said closed end, said closed end having a passage therethrough; and a jumper wire, said jumper wire having an interior portion located within the interior of said wire nut cover and having a connection means for connecting to one or more wires lodged in the interior of said wire nut cover, said jumper wire also having an exterior portion extending through said passage;

wherein the connection means of the interior portion of said jumper wire comprises said interior portion of said jumper wire being formed into a helical shape positioned adjacent to an interior wall of said wire nut cover.

* * * * *